United States Patent [19]

Richardson

[11] Patent Number: 4,938,548

[45] Date of Patent: Jul. 3, 1990

[54] MODULAR MECHANIC'S WORKSTATION

[75] Inventor: Daniel E. Richardson, St. Louis, Mo.

[73] Assignee: Shure Manufacturing Corporation, St. Louis, Mo.

[21] Appl. No.: 857,714

[22] Filed: Apr. 30, 1986

[51] Int. Cl.[5] ..... A47B 41/06

[52] U.S. Cl. ..... 312/233; 312/209; 312/184

[58] Field of Search ..... 312/233, 250, 184, 281, 312/282, 216, 107.5, 209

[56] References Cited

U.S. PATENT DOCUMENTS

| | | | |
|---|---|---|---|
| 943,350 | 12/1909 | Holden | 312/198 X |
| 1,687,443 | 10/1928 | Haskin | 312/233 |
| 1,868,467 | 7/1932 | Sithens | 312/233 |
| 2,527,277 | 10/1950 | Schade | 312/233 X |
| 2,612,427 | 9/1952 | Faulkner et al. | 312/233 |
| 3,455,620 | 7/1969 | Coburn | 312/250 X |
| 3,547,505 | 12/1970 | Ott et al. | 312/209 X |
| 4,073,556 | 2/1978 | Wilson Jr. | 312/250 |
| 4,208,146 | 6/1980 | Schudy | 312/184 X |
| 4,458,961 | 7/1984 | Browning . | |
| 4,496,200 | 1/1985 | Hagstrom et al. . | |
| 4,598,964 | 7/1986 | Frink et al. | 312/216 X |

*Primary Examiner*—Joseph Falk

*Attorney, Agent, or Firm*—Polster, Polster and Lucchesi

[57] ABSTRACT

A modular workstation includes a work surface disposed at a height comfortable for a standing user, a back panel and first and second end panels. A file drawer is secured beneath the work surface. Optionally at least one book holder for suspending books for ready use is disposed in the file drawer. A shelf is secured to the workstation and disposed above the work surface generally at eye level of a standing user of the workstation and optionally a plurality of book holders are disposed on the shelf and pivotably secured thereto. Each book holder is pivotable from a resting position on the shelf to a reading position in which the book holder is suspended from the shelf. A display device for a computer is disposed on the shelf generally at eye level of the standing user and a keyboard is operatively connected to the display. The keyboard is disposed in a housing on the work surface and a lock is provided for locking the keyboard housing on the workstation. A locker suitable for clothes is securely disposed on the work surface. A portable tool chest suitably mounted on casters snugly fits under one portion of the work surface when not in use. A lock is provided for locking the portable tool chest under the work surface.

4 Claims, 7 Drawing Sheets

MODULAR MECHANIC'S WORKSTATION

BACKGROUND OF THE INVENTION

This invention relates generally to equipment for mechanics and similar technicians and more particularly to modular workstations for same.

Modern mechanics are not the dirty "grease monkies" one used to associate with automobile repair. Many are highly trained technicians with highly specialized tools including computer based diagnostic equipment. Of course, mechanics also still use some of the same old tools such as wrenches and the like as well. But the appearance of highly sophisticated equipment in the shop has resulted in the necessity of finding some way of keeping all the mechanic's tools readily accessible, yet out of the way when not needed. In addition, although the mechanic has always needed reference manuals of various sorts to assist him in his tasks, these manuals have now been supplemented by manuals related to the computer based diagnostic equipment. All of these manuals must be kept readily available, and the computer related manuals should be kept in reasonable proximity to the mechanic's input and output equipment (typically a keyboard and a cathode ray tube (CRT) respectively). Of course, these manuals should be kept out of the way when not in use, but they should also be easy to find should the need arise.

Heretofore, work furniture or workstations for the mechanic and similar technicians has not adequately meet the needs. Computer furniture is of course available for organizing computer equipment and the related manuals, but this furniture does not typically contain provisions for storing other tools such as wrenches and the like that one ordinarily associates with a mechanic. Such tools are sometimes stored in a movable cart or chest on casters, but this separate piece of equipment just adds to the clutter when not in use and takes up valuable floor space. Often the mechanic also needs some place to store his personal items while on the job. A separate locker for this purpose further adds to the clutter on the shop floor.

Currently available computer equipment furniture is also not believed to typically include sufficient work area for the mechanic to perform the mechanical chores which his job involves. Computer equipment furniture is designed for those whose job is mainly inputting and outputting information to and from the computer. The mechanic's needs are different. The computer for him is just one of many tools, and not one which normally takes up the greater part of his day. As a result, furniture designed for others does not well suit the mechanic's needs. In addition, the mechanic, unlike many other users of computers, does much of his work while standing and it would be inefficient for him to sit while using the CRT and keyboard. Currently available furniture which organizes the computer equipment for the most part does so under the assumption that the user of the equipment will be seated at the furniture.

SUMMARY OF THE INVENTION

Among the several objects and features of the present invention may be noted the provision of a modular workstation especially suited for mechanics and similar technicians.

Another object of the present invention is the provision of such a workstation which organizes and accomodates both traditional and computer related mechanic's tools.

A third object of the present invention is the provision of such a workstation which places computer related equipment at such a level that the user can operate it while standing.

A fourth object of the present invention is the provision of such a workstation which stores a large number of reference manuals in a relatively small space while leaving the manuals readily accessible when needed.

A fifth object of the present invention is the provision of such a workstation may be readily modified to suit the needs of different users.

Other objects and features may be in part apparent and in part pointed out hereinafter.

Briefly, in a first embodiment of the present invention, a modular workstation for a mechanic or the like includes a work surface disposed at a height comfortable for a standing user such as a mechanic or other technician, a back panel and first and second end panels operatively affixed to the work surface and generally perpendicular thereto. The panels extend upwardly above the work surface. A file drawer is secured beneath the work surface, the file drawer being movable outwardly from the front of the work surface to reveal the contents of the file drawer. At least one book holder is included for suspending books for ready use in the file drawer, the book holder including structure spanning the file drawer for supporting a book above the bottom of the file drawer and structure for mounting a book to the spanning structure. The book holder is readily removable from the file drawer when desired, the file drawer being deep enough to accomodate a plurality of book holders.

In a second embodiment of the present invention, a modular workstation for a mechanic or the like includes a work surface disposed at a height comfortable for a standing user such as a mechanic or other technician, a back panel and first and second end panels operatively affixed to the work surface and generally perpendicular thereto. The panels extend upwardly above the work surface. A shelf is secured to the workstation and disposed above the work surface generally at eye level of a standing user of the workstation. A plurality of book holders are disposed on the shelf and pivotably secured thereto, each book holder being pivotable from a resting position on the shelf to a reading position in which the book holder is suspended from the shelf, the reading position being generally vertical. The shelf prevents further pivoting of each book holder past the reading position.

In a third embodiment of the present invention, a modular workstation for a mechanic or the like includes a work surface disposed at a height comfortable for a standing user such as a mechanic or other technician, a back panel and first and second end panels operatively affixed to the work surface and generally perpendicular thereto. The panels extend upwardly above the work surface. A shelf is secured to the workstation and disposed above the work surface generally at eye level of a standing user of the workstation, the height thereof being adjustable to suit the user. A display device for a computer or electronic equipment is disposed on the shelf generally at eye level of the standing user. A keyboard is operatively connected to the display and associated therewith, the keyboard being disposed in a housing on the work surface. Locking structure is provided for locking the keyboard housing on the workstation for security purposes.

In a fourth embodiment of the present invention, a modular workstation for a mechanic or the like includes a work surface disposed at a height comfortable for a standing user such as a mechanic or other technician, a back panel and first and second end panels operatively affixed to the work surface and generally perpendicular thereto. The panels extend upwardly above the work surface. A locker suitable for clothes is securely disposable at a plurality of locations on the work surface.

In a fifth embodiment of the present invention, a modular workstation for a mechanic or the like includes a work surface disposed at a height comfortable for a standing user such as a mechanic or other technician, a back panel and first and second end panels operatively affixed to the work surface and generally perpendicular thereto. The panels extend upwardly above the work surface. A portable tool chest is suitably mounted on casters or the like, the tool chest being of such a height that it snugly fits under one portion of the work surface when not in use. Structure is provided for locking the portable tool chest under the work surface and for locking the drawers of the tool chest for security of the tools contained therein.

BRIEF DESCRIPTION OF THE DRAWINGS

Similar reference characters indicate similar parts throughout the several views of the drawings.

DESCRIPTION OF THE PREFERRED EMBODIMENT

Figure 7:
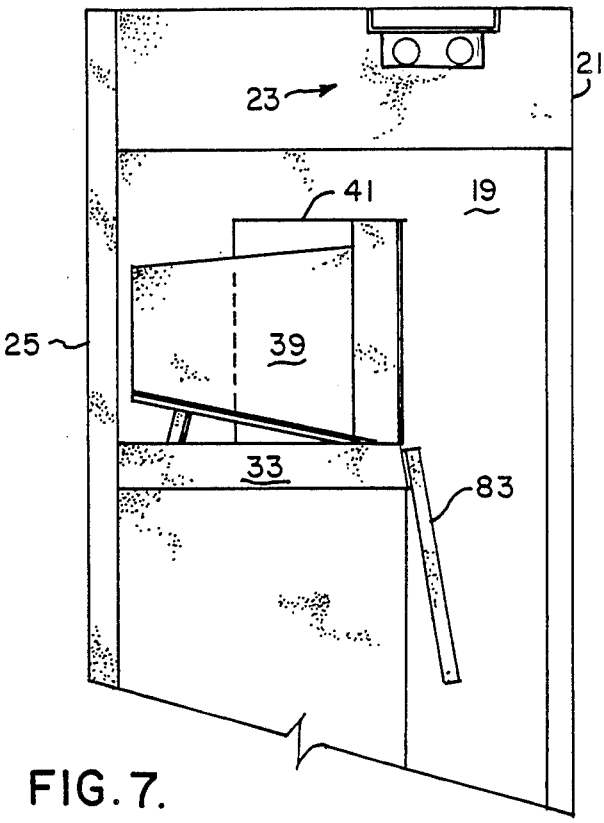
FIG. 7 is a side elevation of the top portion of the workstation of FIG. 1 illustrating the placement of a computer display.

A modular mechanic's workstation 11 (FIGS. 1 and 2) preferably includes a one and three-quarters inch thick hardwood work surface 13 disposed at a convenient level (e.g., thirty-seven inches above the floor) for a standing user. The work surface is supported by a reinforced leg 15, disposed generally at the midpoint of the work surface, and a pair of end panels 17 and 19 disposed at each end of the work surface. The end panels extend above the work surface to support a workstation top 21 extending the width of the work surface and including an appropriate lighting fixture 23 (FIG. 7). The workstation also includes a back panel 25 extending the width of the workstation, which back panel includes perforated panel inserts 25A and 25B. A power outlet strip 26 is disposed on back panel 25 to provide electrical power for the mechanic's equipment as needed.

Figure 1:
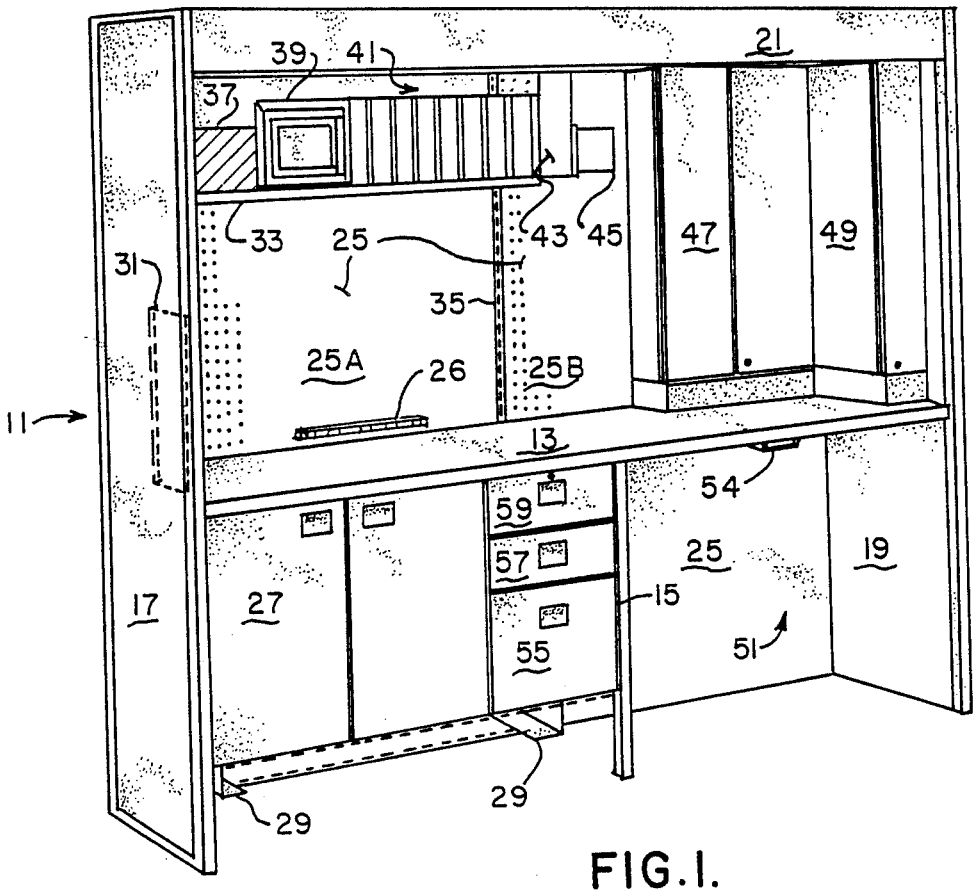
FIG. 1 is a perspective view of a modular mechanic's workstation of the present invention.
Figure 2:
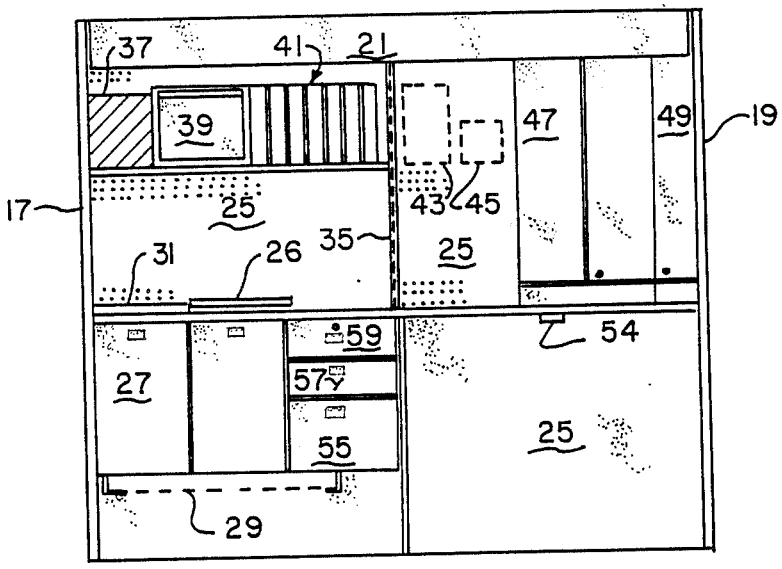
FIG. 2 is a front elevation of the modular workstation of FIG. 1.

A number of modules and various tools and pieces of equipment may be used with the basic workstation heretofore described. Typical modules are shown in FIGS. 1 and 2, although it should be realized that any particular workstation could have fewer than all these modules, or even additional or different modules. For example, the workstation shown includes a storage cabinet module 27 securely disposed under work surface 13. A rack 29 for storing a creeper is provided immediately below the storage cabinet. Above the storage cabinet and hingedly secured to end wall panel 17 is a housing 31 for a computer keyboard. As will become apparent, housing 31 locks in the position shown in FIG. 1 to prevent tampering with the keyboard or theft and when unlocked it is disposed in the horizontal position shown in FIG. 2 in which it can be used by a standing user.

A cantilevered shelf 33 is secured to back panel 25 (more specifically is secured to and supported by a pair of upstanding posts 35, only one of which is shown) and is disposed generally above the left half of the work surface below lighting fixture 23. Of course, since workstation 11 is modular, the exact placement of shelf 33 is a matter of choice, as is the case with all the modules. This shelf may be used to support various of the mechanic's tools and associated gear. As shown in FIG. 1, shelf 33 is used to support an intercom 37, a computer display device 39, and the mechanic's reference manuals 41. This shelf is adjustable in height and may be disposed at any convenient level for the user, such as eye level. To the right of shelf 33 are places to store other necessities such as a shop vacuum 43 and disposable wipes 45.

Figure 12:
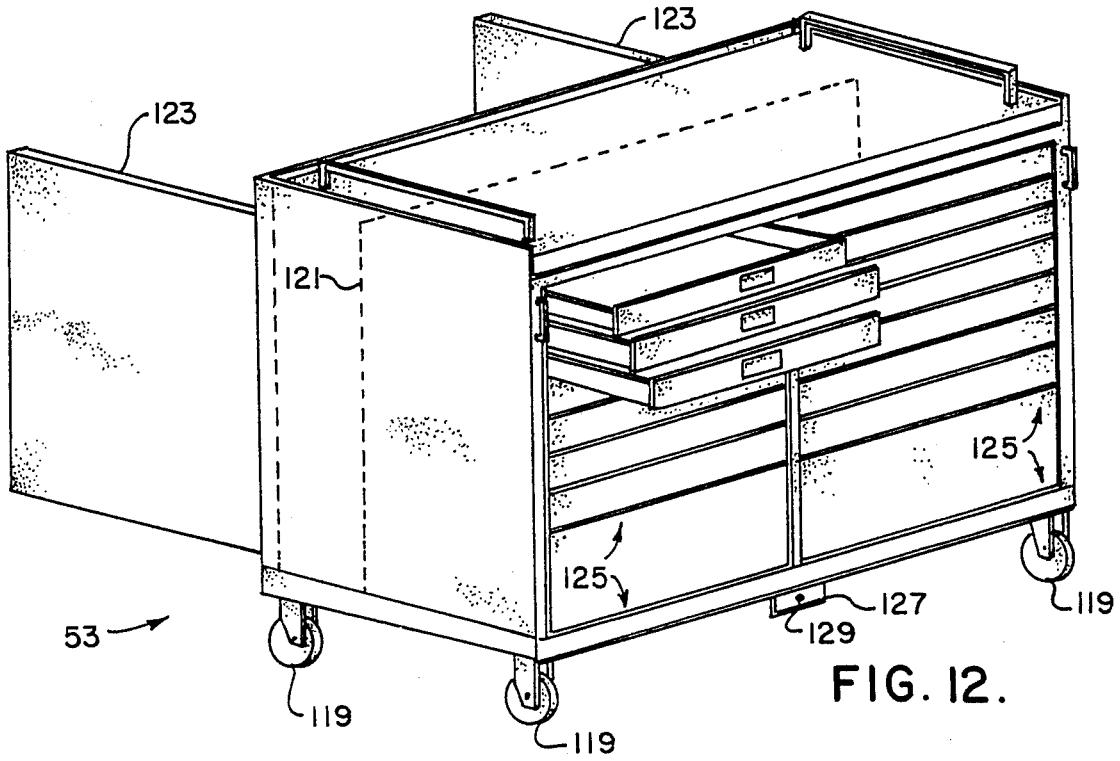
FIG. 12 is a perspective view of a movable tool chest module of the workstation of FIG. 1.

Moving to the right-hand side of the workstation, a locking tool cabinet 47 is fixedly secured to the back panel 25 of the workstation. This cabinet is relatively shallow (e.g., eight and three-quarters inches) so that it does not take up all of work surface 13. To the right of tool cabinet 47 is a clothes locker 49 which abuts right panel 19. A cavity 51 is provided under work surface 13 immediately below tool cabinet 47 and locker 49 for a movable tool chest 53 (FIG. 12). Cavity 51 is defined by work surface 13, right end panel 19, rear panel 25, and leg 15. A locking flange 54 is provided as part of the workstation to secure tool chest 53 in place in cavity 51 when the chest is not in use. To the left of leg 15 is a set of three file drawers 55, 57 and 59 making up a filing cabinet 60. The bottom file drawer may optionally be used in place of or in addition to shelf 33 for storing the mechanic's reference manuals.

Figure 3:
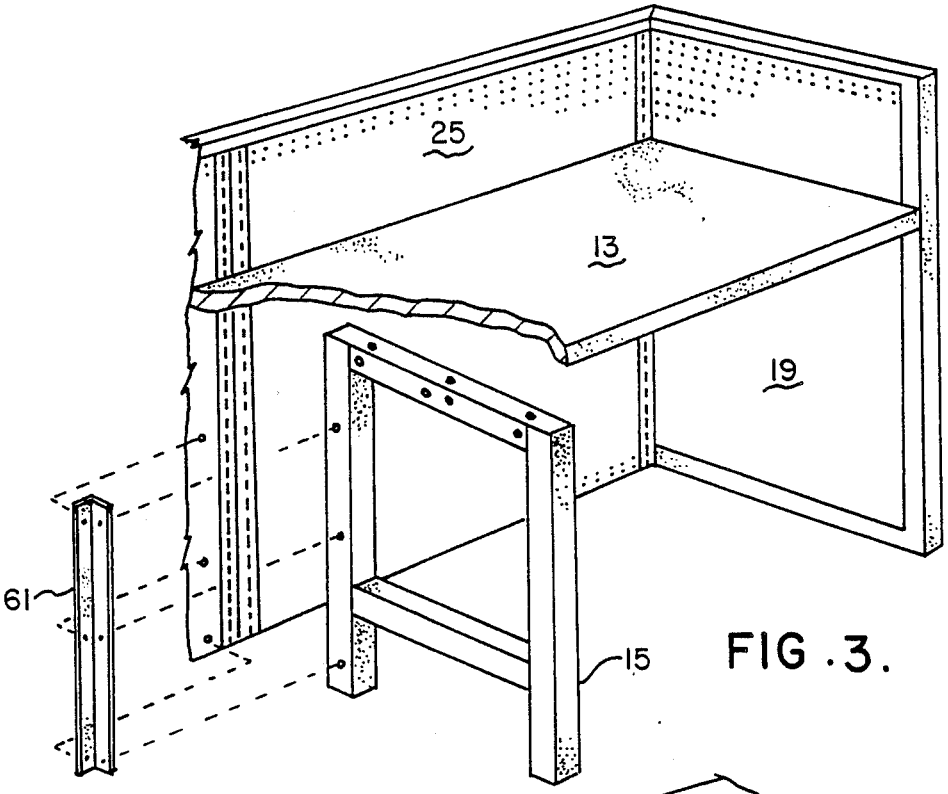
FIG. 3 is a perspective view illustrating the construction of the workstation of FIG. 1.
Figure 4:
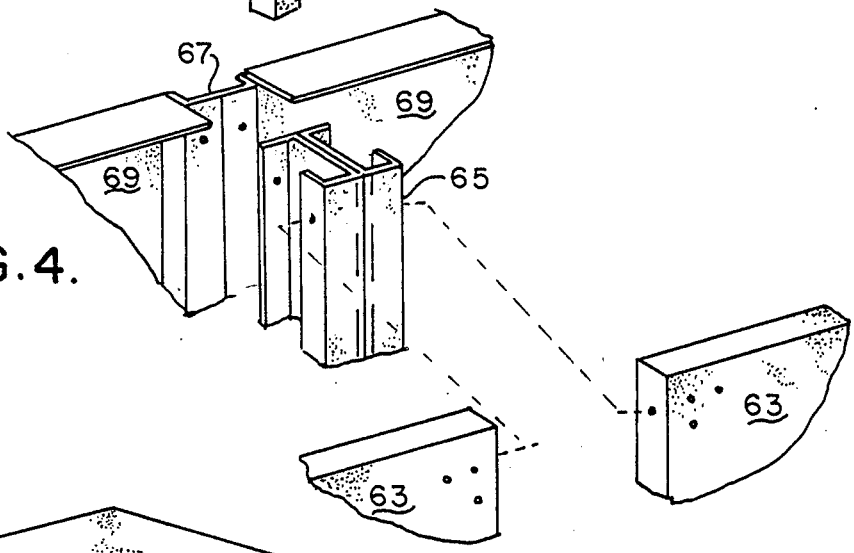
FIG. 4 is a detail drawing further illustrating the construction of the workstation of FIG. 1.
Figure 5:
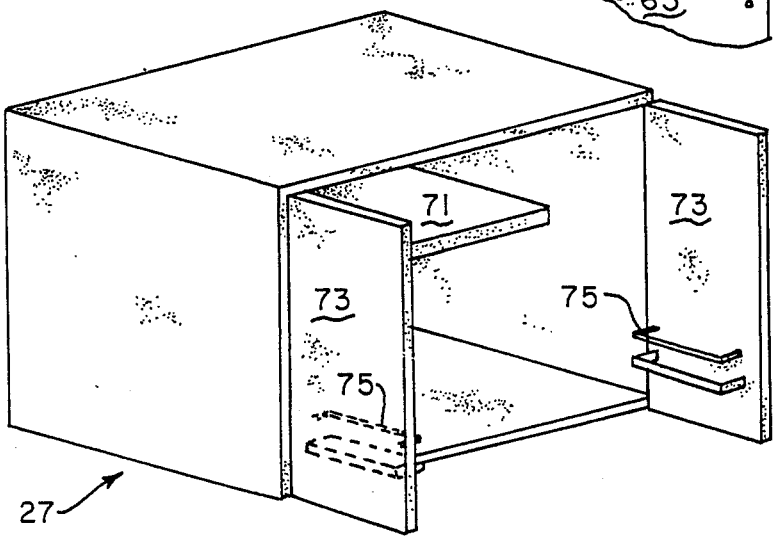
FIG. 5 is a perspective view of a storage cabinet module of the workstation of FIG. 1.

The construction of workstation 11 is illustrated in FIGS. 3 and 4. Leg 15 is suitably secured to work surface 13 by three screws as shown, and the leg is attached to back panel 25 by an angle iron 61. Each panel is made up of panel inserts suitably connected to upstanding metal posts. For example, back panel 25 (FIG. 4) includes interior panel inserts 63 (preferably perforated) which are secured to a post or upright 65. Upright 65 is in turn secured to another upright post 67 to which exterior panel inserts 69 are secured. This construction is extremely flexible and provides a one and one-half inch void between the interior and exterior panel inserts which may be used as a wiring trough Storage cabinet 27 (FIG. 5) includes at least one interior shelf 71 and a pair of doors 73. Each door preferably includes a rack 75 suitably sized for the storage of aerosol cans. For convenience and cleanness of design, the self-closing door hinges for storage cabinet 27 are concealed. Storage cabinet 27 is of sufficient size to hold much of the mechanic's equipment. For example, the storage cabinet shown is twenty-two inches deep, thirty inches wide, and twenty-four inches tall.

Figure 6:
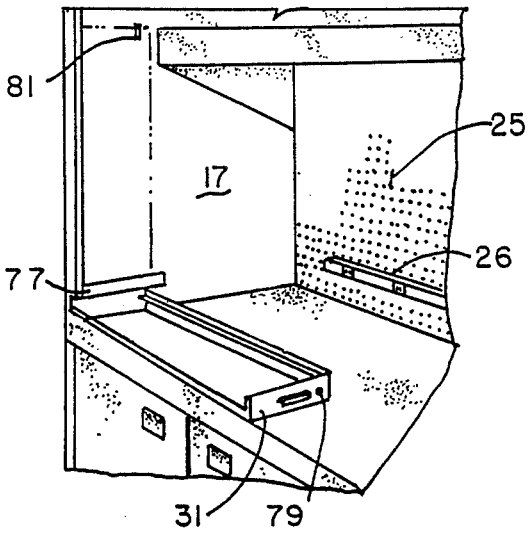
FIG. 6 is a perspective view of a keyboard housing of the workstation of FIG. 1.

Keyboard housing 31 (FIG. 6) is hinged at 77 so that it may be swung from the use position of FIG. 6 to the storage position of FIG. 1. The housing includes a key-operated latch 79 which may be used to lock the keyboard housing in place against side panel 17. More particularly, side panel 17 has a cooperating lug 81 disposed thereon which is engaged by latch 79 when the housing is in its vertical position to latch the housing in the secure position.

Figure 8:
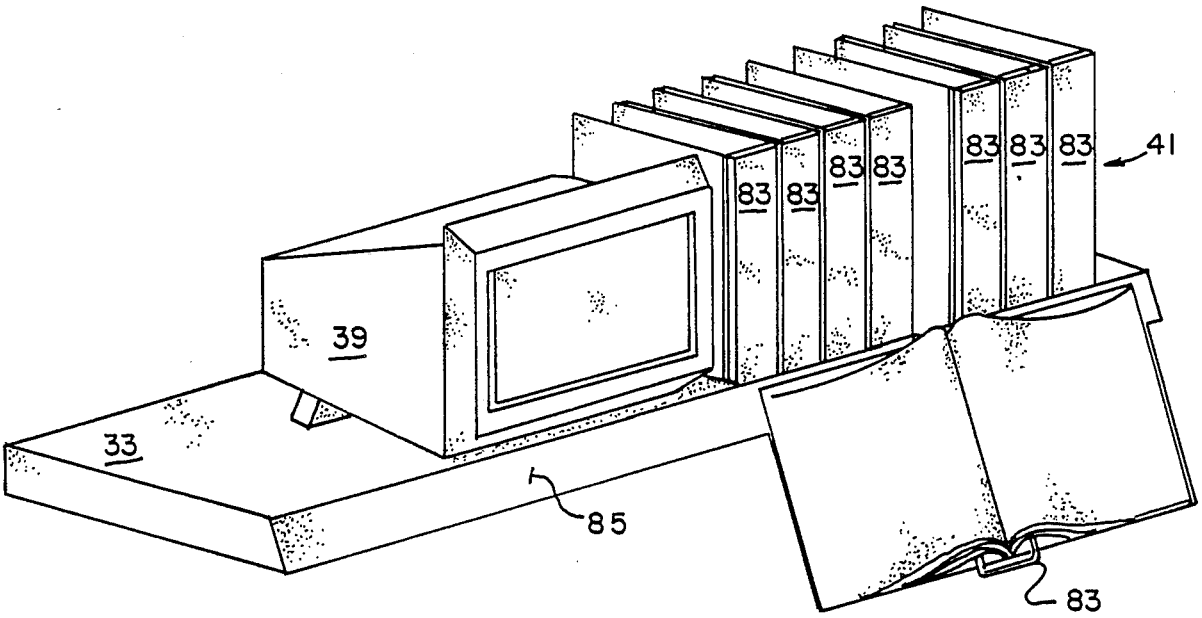
FIG. 8 is a perspective view of the portion of the workstation shown in FIG. 7 with parts removed for clarity, illustrating a possible placement of reference manuals near the computer display.

Shelf 33 (FIGS. 7 and 8) is disposed generally at eye level for the mechanic so that the computer display 39 is readily visible, although the height can readily be adjusted to suit the individual user. It is also placed at this level so that the reference manuals may be swung from their positions on the shelf to a reading position shown in FIG. 8. More specifically, each reference manual is held in a book holder 83 which is hingedly secured to shelf 33 at the front thereof so that each reference manual and holder may be pivoted from the storage position shown in FIGS. 1 and 2 to the use position shown in FIG. 8. To aid in holding the manuals in the proper position for reading, shelf 33 has an inclined front wall 85 making a small angle of, for example, ten degrees with the vertical.

Figure 9:
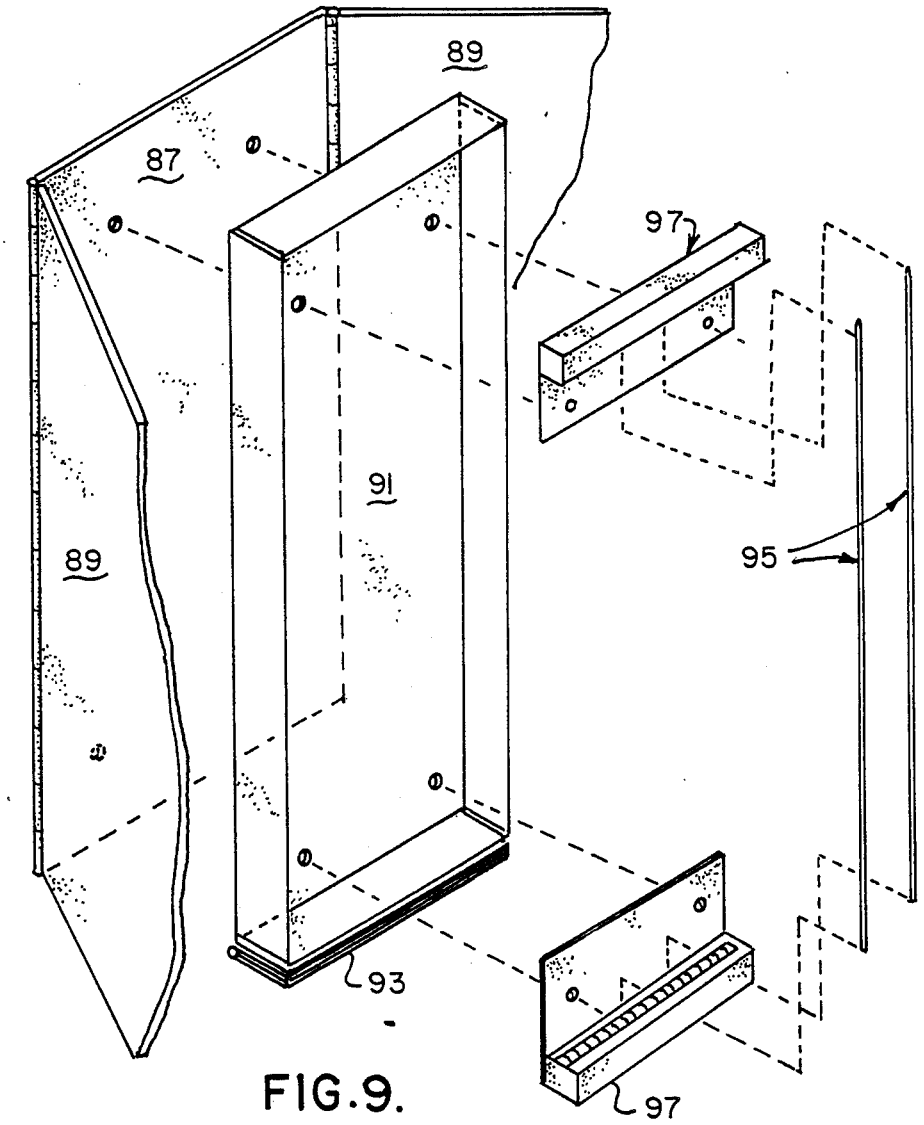
FIG. 9 is an exploded view of reference manual holders used in FIG. 8.

Each book holder 83 (FIG. 9) includes a binder 87 having hinged flaps 89, a book casing 91 secured by welding or the like to a hinge 93 which is also secured to the shelf, a plurality (a pair is shown) of rods 95 for holding the reference manual or manuals to the casing, and a pair of rod holders 97 disposed at each end of the casing for receiving the rods. The spine of the reference manual is held against casing 91 by rods 95 and the binder, casing and rod holders are suitably secured together by screws or the like.

Figure 10:
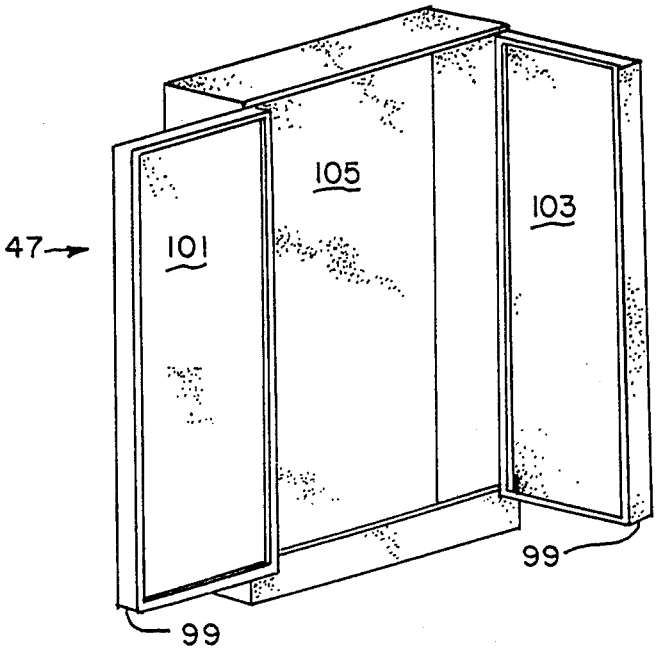
FIG. 10 is a perspective view of a tool cabinet module of the workstation of FIG. 1.

Tool cabinet 47 (FIG. 10) includes a pair of doors 99 with self-closing concealed hinges and a lock (not shown) for security. Preferably the doors and the back of the cabinet have perforated panel inserts 101, 103 and 105 to facilitate the storage of the mechanic's tools in the cabinet. The cabinet itself is relatively shallow (e.g., eight and three-quarters inches) but stands thirty-nine and one-half inches high and is twenty-two and one-half inches wide.

Figure 11:
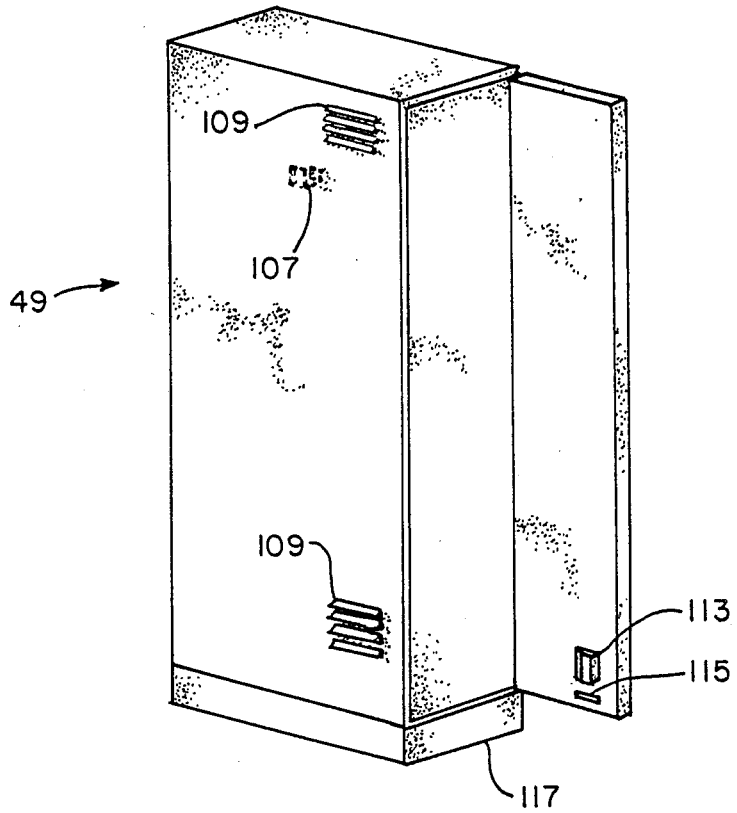
FIG. 11 is a perspective view of a clothes locker module of the workstation of FIG. 1.

Foot locker or clothes locker 49 (FIG. 11) includes a coat hook 107, a pair of vents 109, and a door 111 having selfclosing concealed hinges. The door also has a recessed handle 113 and a lock 115. A removable drip pan 117 is disposed in the bottom of the locker. Locker 49 is sized to fit beside tool cabinet 47 on work surface 13. It is eleven inches wide, thirty-nine and one-half inches tall, and nineteen and thirteen-sixteenths inches deep. Of course, it could also be disposed at other locations on workstation 11.

Figure 13:
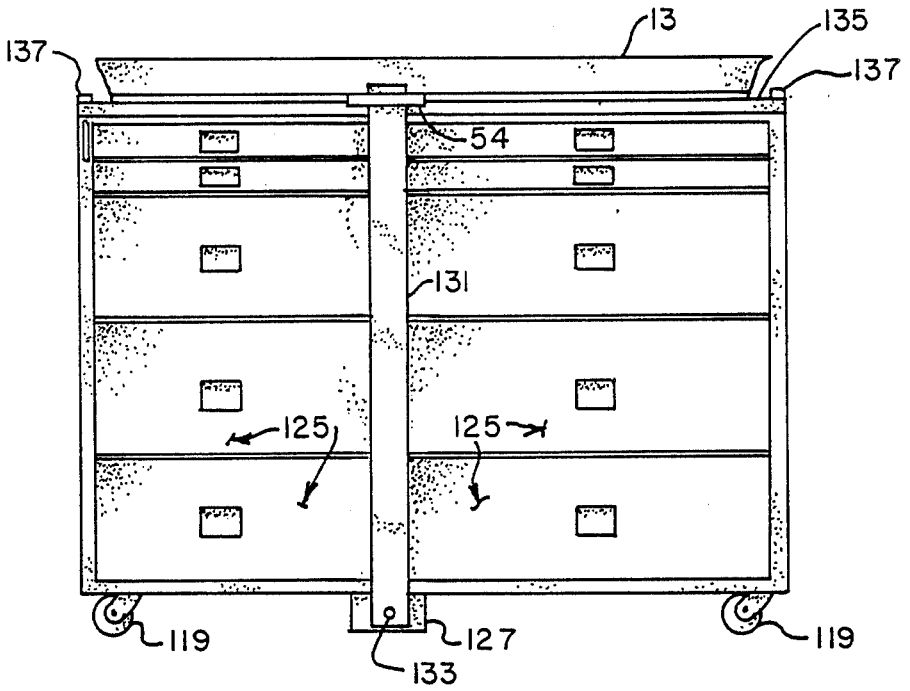
FIG. 13 is a front elevation of the movable tool chest module of FIG. 12.

Portable tool chest 53 (FIGS. 12 and 13) has mounted thereto four swivel casters 119 to make it portable. It has a rear storage area having a perforated panel 121, which storage area is accessible through a pair of doors 123. The front of the tool chest includes a set of tool drawers 125 which slide into and out of the tool chest. A flange 127 having an opening 129 therein in disposed at the lower front of the tool chest. The opening is used in combination with locking flange 54 (FIGS. 1, 2 and 13) and a locking strap 131 (FIG. 13) to lock the tool chest in cavity 51 when not in use and to lock the tool chest drawers closed at the same time. Locking strap 131 is held at its upper end by locking flange 54 and its lower end has an opening 133 in registry with opening 129 of flange 127. A padlock or other suitable locking device may be inserted through openings 129 and 133 to lock the portable tool chest in place when not in use. Lock bar or strap 131 slides under work surface 13 when not in use. The tool chest also includes a one and three-quarter inch thick hardwood top 135 and a pair of handles 137.

Figure 14:
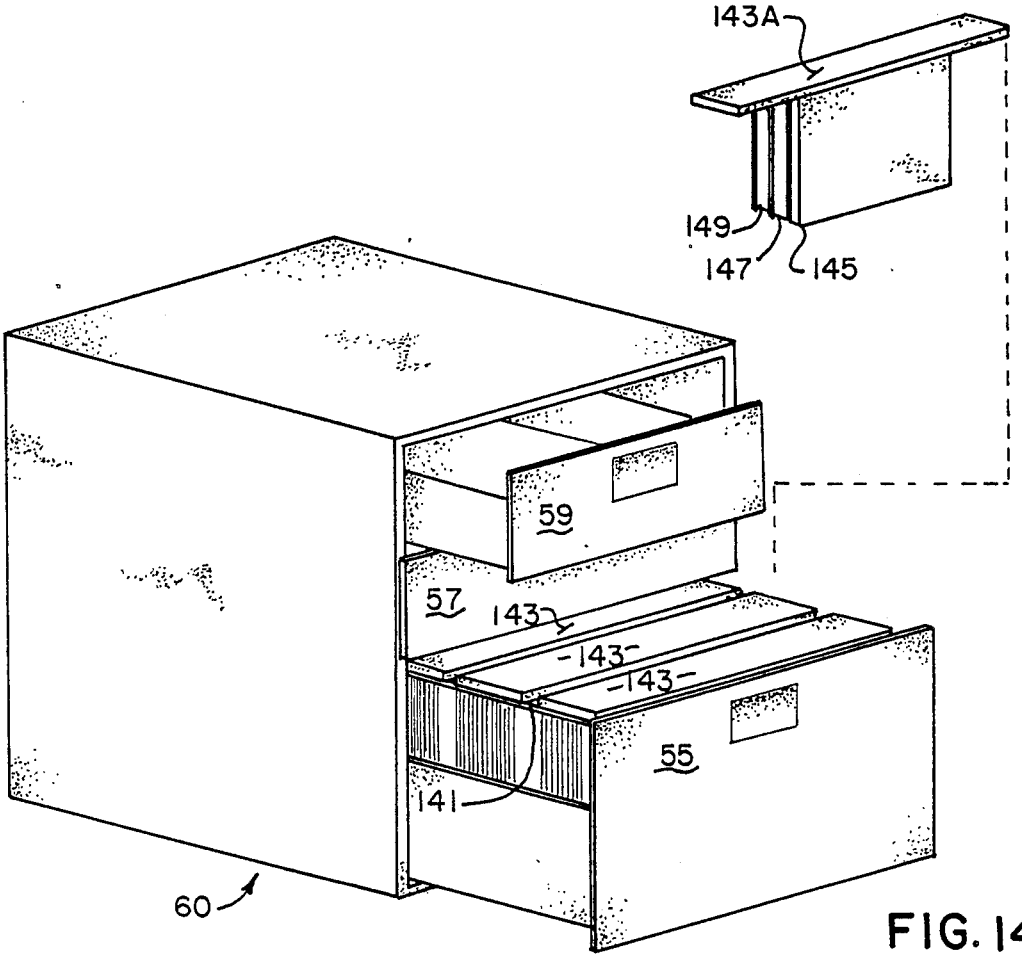
FIG. 14 is a perspective view of a file cabinet module of the workstation of FIG. 1, illustrating an alternative mounting arrangement for reference manuals.
Figure 15:
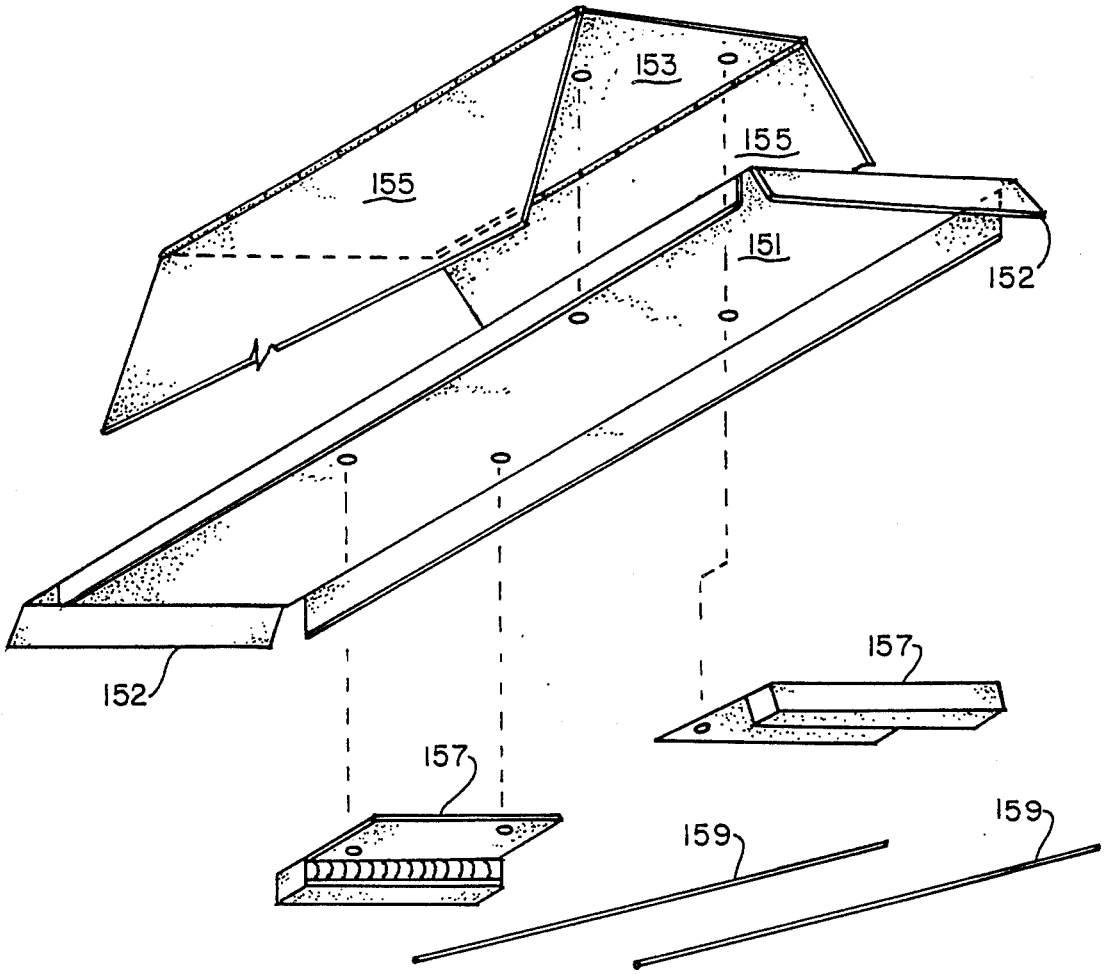
FIG. 15 is an exploded view of manual mounting hardware usable with the file cabinet of FIG. 14.

File cabinet 60 (FIGS. 14 and 15) is eighteen inches wide, twenty-four inches tall, and twenty-two inches deep. Bottom drawer 55 includes a pair of rails 141 (only one of which is shown) on each side thereof to support a number of manual holders 143. Each manual holder may hold one or more of the mechanic's reference manuals. For example, the manual holder labelled 143A in FIG. 14 holds three manuals 145, 147 and 149. Each manual holder includes a spanning member 151 (FIG. 15) which extends from side to side of file drawer 55 and rests upon rails 141, thereby suspending the attached reference manuals above the bottom of the file drawer. The spanning member has a lip 152 at each end to engage the corresponding rail 141. A binder 153 having hinged flaps 155 is secured to one side of the spanning member, while a pair of rod holders 157 are secured to the other side of the spanning member. A number of rods 159 are provided to secure the manuals to the manual holder. A larger or smaller number of rods will be needed depending upon how many different manuals are mounted in a particular manual holder.

In view of the above, it will be seen that the various objects and features of the invention are achieved and other advantageous results are attained.

As various changes could be made in the above constructions without departing from the scope of the invention, it is intended that all matter contained in the above description or shown in the accompanying drawings shall be interpreted as illustrative and not in a limiting sense.

What is claimed is:

1. A modular workstation for a mechanic or the like comprising:

a work surface disposed at a height comfortable for a standing user such as a mechanic or other technician;

a back panel and first and second end panels operatively affixed to the work surface and generally perpendicular thereto, said panels extending upwardly above the work surface;

a locker suitable for clothes securely disposable at a plurality of locations on the work surface; and a tool cabinet fixedly disposable at a plurality of locations on the work surface.

2. A modular workstation as set forth in claim 1 wherein the tool cabinet is secured thereto adjacent the locker.

3. The modular workstation as set forth in claim 1 further including a portable tool chest suitably mounted on casters or the like, said tool chest being of such a height that it snugly fits under one portion of the work surface when not in use, and means for locking the portable tool chest under the work surface.

4. The modular workstation as set forth in claim 3 wherein the locking means includes a locking flange secured to the workstation, a locking flange secured to the tool chest, and a locking strap securable to both locking flanges to lock the tool chest in place in the workstation.

* * * * *